United States Patent [19]

Lebouc

[11] 4,373,855

[45] Feb. 15, 1983

[54] TOOL CARRIER UNIT MOVABLE OVER A TUBE-PLATE

[75] Inventor: Bernard Lebouc, Dinan, France

[73] Assignee: Framatome, Courbevoie, France

[21] Appl. No.: 154,864

[22] Filed: May 30, 1980

[30] Foreign Application Priority Data

May 31, 1979 [FR] France ..... 79 14020

[51] Int. Cl.[3] ..... F28G 15/08; B25S 9/00

[52] U.S. Cl. ..... 414/744 R; 165/76; 414/750

[58] Field of Search ..... 414/744 R, 744 A, 749, 414/750, 751; 165/76

[56] References Cited

U.S. PATENT DOCUMENTS 3,913,752 10/1975 Ward et al. ..... 414/750
3,984,008 10/1976 Syun-Ichi et al. ..... 165/76 X
4,004,698 1/1977 Gebelin ..... 165/76 X
4,018,345 4/1977 Formanek et al. ..... 414/750 X
4,193,735 3/1980 Savor et al. ..... 414/744 R

*Primary Examiner*—Jeffrey V. Nase
*Attorney, Agent, or Firm*—Pollock, Vande Sande & Priddy

[57] ABSTRACT

A tool carrier unit, intended to be moved over a tube plate, comprises two perpendicular arms equipped with devices for engaging in the holes of the plate, and for moving the unit, step by step, by relative movement of the arms, across the plate. The unit comprises a supporting element in the form of an angle bracket defining a vee arranged with its apex perpendicular to the plate. The arms are arranged external to the vee, and at the inside of the vee, unaffected by the movement of the arms, guides are provided for supporting a tool.

3 Claims, 7 Drawing Figures

TOOL CARRIER UNIT MOVABLE OVER A TUBE-PLATE

The present invention relates to a tool carrier unit intended to be moved, by remote control, over a tube plate. It is particularly applicable to maintenance duties on a steam generator in a nuclear power station.

In a pressurized-water nuclear power station, the very numerous tubes of the steam generator tube bundles must be subjected to periodical inspection and maintenance operations, such as, for example, welding operations, insertion of blanking plugs to stop-off defective tubes, or operations on the interior lining of the tubes. These maintenance operations must be performed starting from the water-box, i.e., in a highly radioactive region; it is thus necessary to use remotely controlled devices in order to restrict human intervention to the simple positioning of equipment. Furthermore, the steam generators are usually of the vertical-tube type, i.e., the tube plate is then the "ceiling" of the water-box.

Devices capable of being moved by remote control, under the tube-plate of a steam generator have already been produced. U.S. Pat. No. 4,004,648 describes such a device, comprising two perpendicular arms furnished with means for engaging in the holes of the plate, and means for imparting relative movement to the arms, parallel and perpendicularly to the tube plate, in order to enable the whole assembly to be moved step by step, by successively engaging each of the arms and moving one of them while the other one is engaged.

The use of such a device, however, is restricted to the positioning of guides for inspection probes which are to be inserted into the tubes, these guides being necessarily located at the ends of the arms, due to the obstruction of the central part of the device. This entails no disadvantage for simple guides, but does not allow the use of more complicated and heavier tools such as milling-heads or welding heads.

The present invention remedies these disadvantages by allowing the production of a device, also relying on remotely controlled automatic movements on a tube plate, achieved by relative movements of two perpendicular arms, but also capable of being used as a support for the heads of various tools required for the maintenance of the plate and of the tubes which connect thereto.

According to the invention there is provided a tool carrier unit, movable over a tube plate, comprising two perpendicular arms provided with remotely controllable devices for engaging in holes of the tube plate, remotely controllable means for moving to the arms in directions parallel and perpendicular to the tube plate to enable the unit to be moved step by step thereacross, by successively engaging each of the arms and moving one of them while the other is engaged, a supporting element in the form of an angle bracket defining a vee, the apex of the vee being, in use, perpendicular to the tube plate, each arm being carried independently of the other and external to the vee by means of a carriage mounted on a slide attached to the supporting element, the independent remotely controllable means being arranged to move each arm on its respective carriage parallel to the tube plate, and to move each carriage slide on the slide perpendicular to the tube plate, and in the interior of the vee, unaffected by movement of the arms the supporting element is provided with guides for a tool which is movable perpendicularly to the tube plate.

In a preferred embodiment, the unit includes, at that end of the supporting element opposite the end adjacent the tube plate, a rotating turret provided with supporting guides for a plurality of tool heads, and means for selectively introducing one of said tool heads on stand-by into the interior of the vee of the supporting element, the supporting guides being then aligned with the guides of the vee, the unit also including means for transferring a tool onto the guides in the interior of the vee.

The invention will be better understood from the following description of several embodiments thereof given by way of example only, and illustrated in the accompanying drawings.

Figure 1:
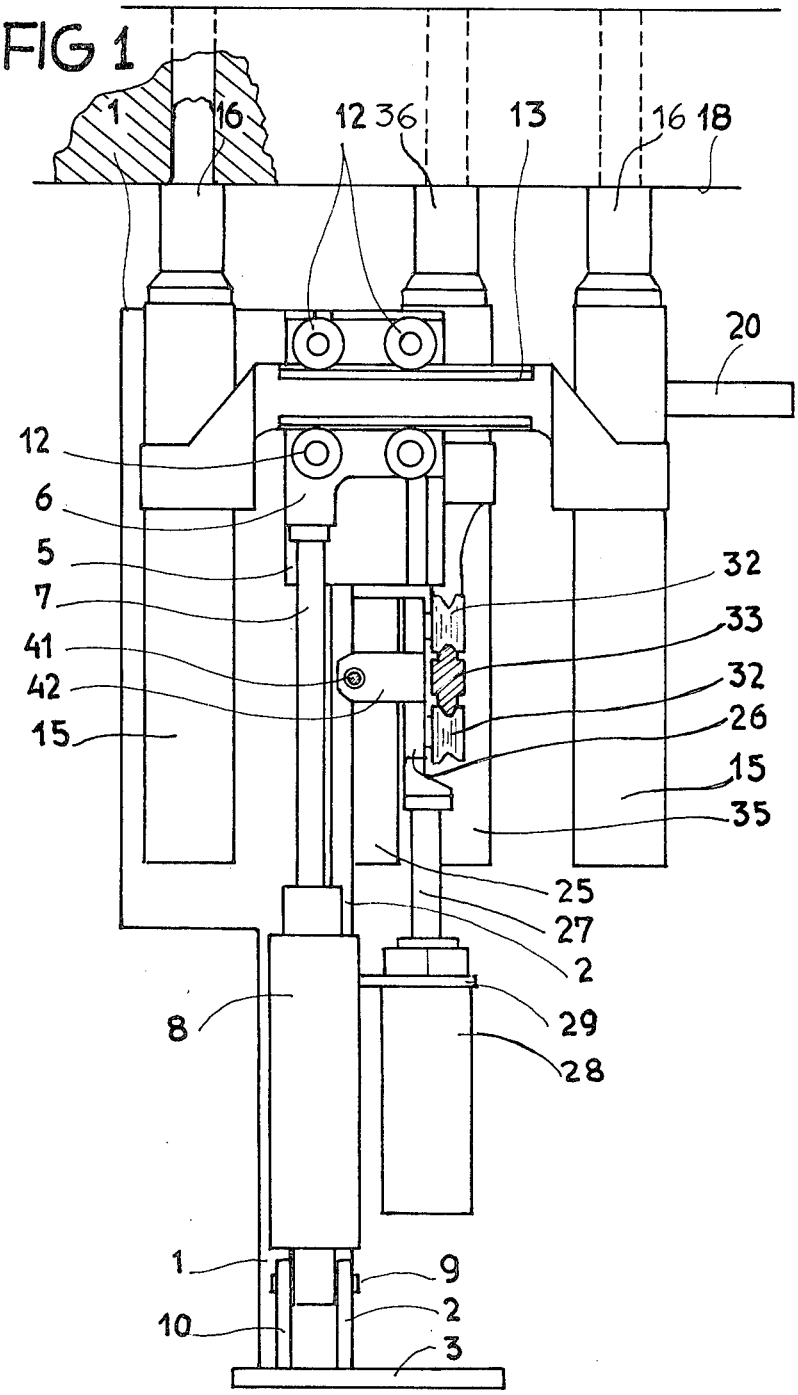
FIG. 1 is a view in elevation of a tool-carrier unit according to the invention, along line I—I of FIG. 3.
Figure 2:
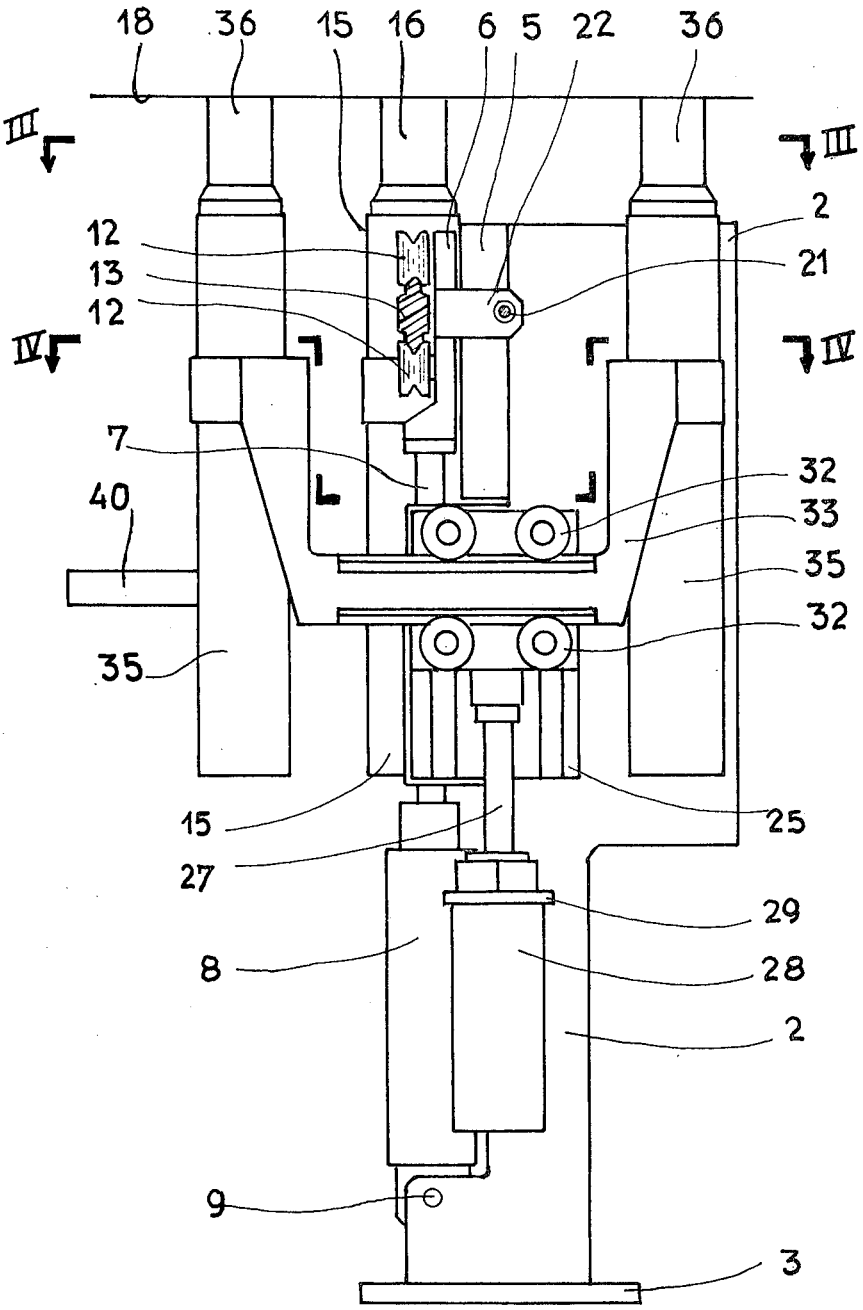
FIG. 2 is another view in elevation along line II—II of FIG. 3.

Referring first to FIGS. 1 to 4, it will be seen that the supporting element of the tool carrier is formed principally by two plates, 1 and 2, welded to each other to form an angle bracket, and welded at their base to a plate 3, which is approximately square in shape.

The plate 1 carries a ball-bearing slide 5, in which runs a carriage 6 connected to the end of the rod 7 of a jack 8. The body of the jack 8 is pivotably connected, at 9, to an extension of the lower part of the plate 2 and to an auxiliary support 10. The carriage 6 carries a set of four idler rollers 12, between which an arm 13 can slide, the central part of the arm having a section matched to the profile of the rollers. At each of its ends, the arm 13 carries a jack 15, which controls engagement of expanding latches 16, here shown engaged, by their expanding part, in the holes of the tube plate 18. These latches may be, for example, of the type shown in greater detail in the earlier French Patent No. 4,004,698. The body of a jack 20 is integrally attached to one end of the arm 13, and its rod 21 is connected to an extension 22 of the carriage 6.

In a completely analogous manner, the plate 2 carries a ball-bearing slide 25, in which slides a carriage 26, connected to the end of the rod 27 of a jack 28. The body of the jack 28 is attached to a support 29, welded on the plate 2.

The carriage 26 carries a set of four idler rollers 32, between which an arm 33 can slide. At each of its ends, the arm 33 carries a jack 35, which controls expanding latches 36, engaged in the holes of the tube plate 18. The body of a jack 40 is integrally attached to one end of the arm 33, and its rod 41 is connected to an extension 42 of the carriage 26.

Figure 3:
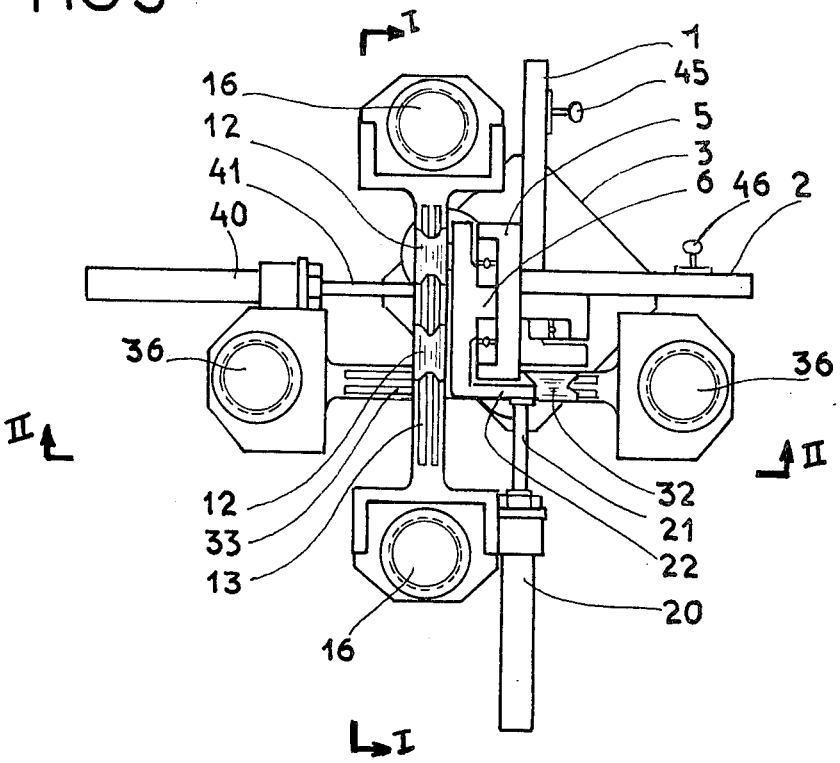
FIG. 3 is a plan view of the unit, along line III—III of FIG. 2.
Figure 4:
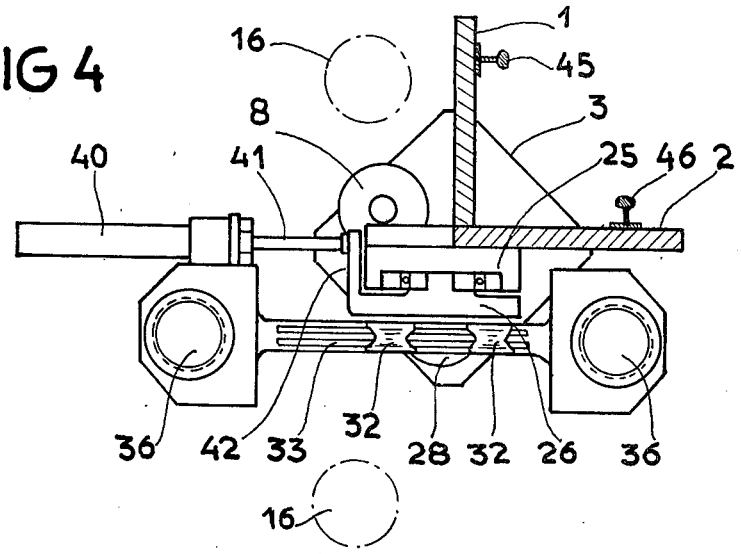
FIG. 4 is a section along line IV—IV of FIG. 2.

It is seen, in particular from FIGS. 3 and 4, that the interior of a vee formed by the plates 1 and 2 of the supporting element is left completely free from the movement of the arms 13 and 33, as well as from the movement of their control jacks. This region may therefore be used to raise a tool head up against the plate. For this purpose, each plate 1 and 2 carries a guide 45 and 46, parallel to the apex of the vee, i.e., perpendicular to the tube plate when the tool carrier is in place.

Figure 5:
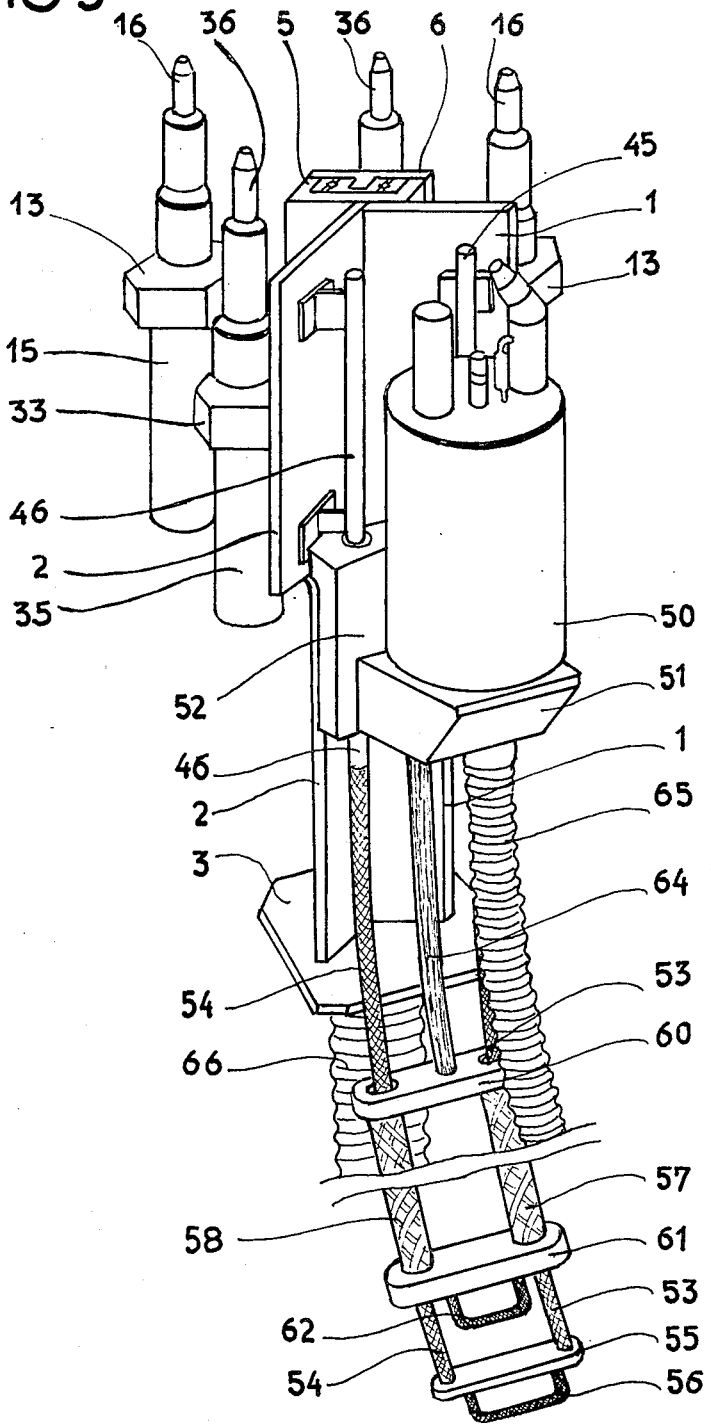
FIG. 5 is a simplified perspective view of an embodiment using a single manually remote-controlled tool.

Reference will now be made to FIG. 5, where an automatic argon welding head is seen in place inside the vee. The actual welding head 50 is carried on a block 51, integral or fast with a slider 52, which engages on the guides 45 and 46. Here, the operation of raising the head up into the working position on the tube-plate i.e., the operation of moving it along the guides 45 and 46, is achieved by manual remote control from outside the water box. The rigid guides 45 and 46 are each prolonged by flexible guides 53 and 54, the length of which is such that their other ends are always outside the water box, irrespective of the position of the device on the tube plate. They are connected at their ends by a crosspiece 55, which maintains the same spacing between the flexible guides as between the rigid guides 45 and 46. The crosspiece 55 carries a handle 56. Each of the guides 53 and 54 runs inside a sheath 57 and 58, which is flexible but rigid in axial compression, the two sheaths being connected at each end by a crosspiece 60 and 61, the latter furnished with a handle 62. Finally, the crosspiece 60 is connected to the block 51 by means of a cable 54, which is flexible but rigid in compression.

It will be seen that by pushing or pulling on the handle 62, while taking up the reaction on the crosspiece 55 or the handle 56, it is possible to move the head 50 along the guides 45 and 46 at will, relative to the tube plate, when the whole unit has been placed in position on the plate, in such a way that the head is opposite the tube to be operated upon.

Sheath 65 contains the cables or tubes for the remote control of the actual welding head. Sheath 66 contains cables or tubes for the remote control of the jacks 8, 20, 28 and 40 for moving the arms, i.e., for moving the tool carrier over the plate, as well as those for controlling the jacks 15 and 35 which operate the attachment latches. Finally, it will be seen that it remains possible to change a tool without detaching the tool carrier from the tube-plate. It is sufficient to release the crosspiece 55, in order to be able to pull the handle 62 to its fully extended position and to withdraw the complete assembly of the head 50 and its sliding carrier 52, which will be guided towards the outside by the flexible guides 53 and 54, from the water box. It is then possible to fit, in the same manner, another slider, carrying another tool, e.g., a milling head or drilling-head, which can in its turn be brought into the working position against the plate.

Figure 6:
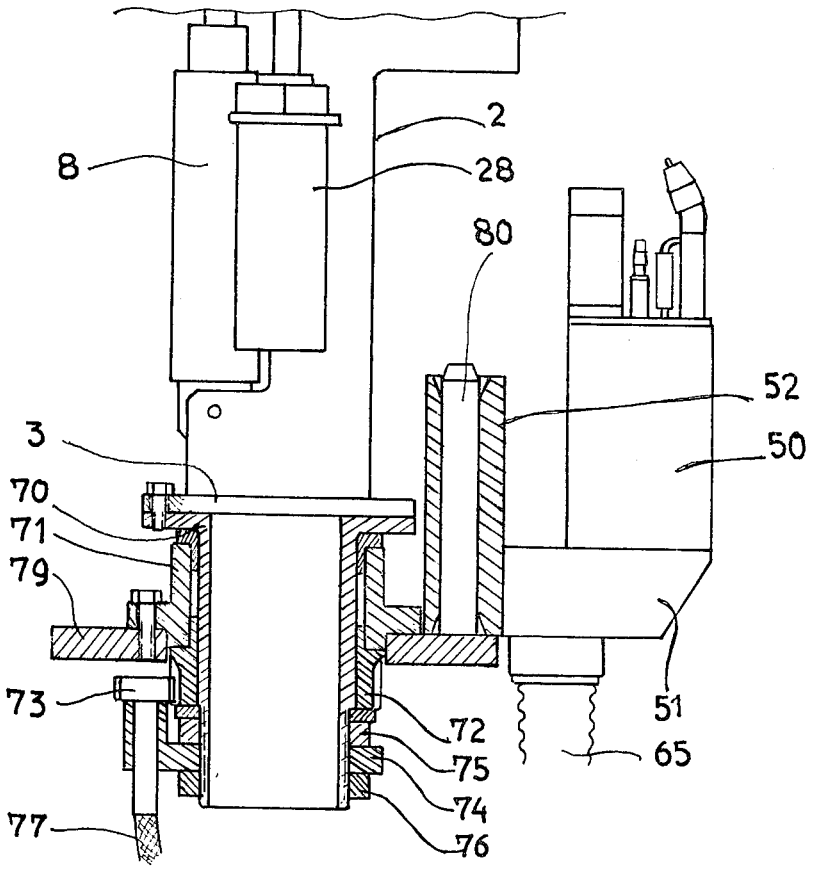
FIG. 6 is a view in elevation, and partly in section, of the lower part of the tool carrier unit shown in in FIG. 2, but equipped with a turret carrying a plurality of interchangeable tools.

The tool changing system can be improved by using a tool carrier turret, allowing location of all the tools expected to be used inside the water-box. FIG. 6 shows the installation of such a turret. It comprises a pintle 70, bolted under the plate 3, on which is mounted a rotatable barrel 71 which is integral or fast with the toothed ring 72. The ring and the barrel are caused to rotate by the pinion 73, carried on a support 74, which is prevented from turning on the pintle by rings 75 and 76, the ring and the barrel being remotely controlled via a flexible cable 77. The barrel 71 supports a turntable 79, which is furnished with guides 80, which are at the same spacing as the guides 45 and 46. The turntable 79 comprises three or four sets of paired guides 80, distributed around its axis at different angular positions.

Figure 7:
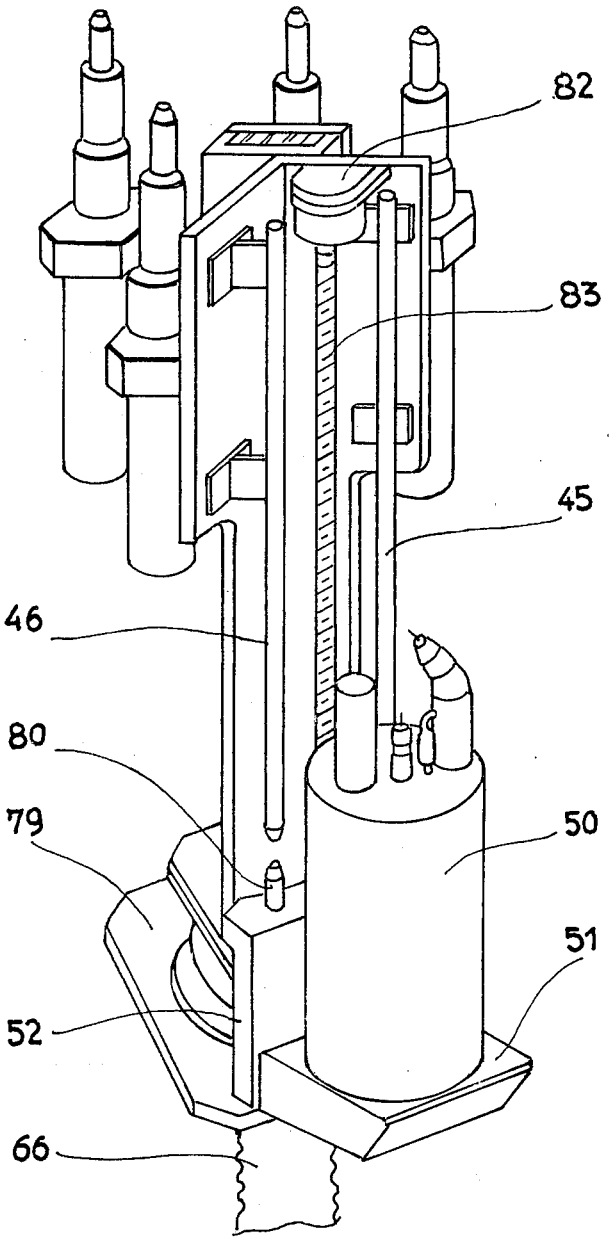
FIG. 7 is a view similar to that of FIG. 5, of a unit with a turret.

If, by rotating the turret and the turntable 79, the slider 52 is brought from its stand-by position to an active position inside the vee of the supporting element, the guides 80 will come into alignment with the guides 45 and 46, as is seen in FIG. 7. Also, the tool carrier is here provided, in the working vee, with a screw-elevator mechanism, consisting of a motor 82 driving a vertical screw 83 which then engages in a mating nut carried by the slider 52. Remote control of the screw 83 allows the complete welding head to be raised into the active position against the tube plate. To change a tool, it is then sufficient to bring the head down again onto its supporting guides 80 of the turntable, then to turn the latter in order to bring another head into the vee and to bring the head up into the working position by means of the screw 83.

It will further be noted that it is also possible to use a screw mechanism 82-83 in the embodiment shown in FIG. 5, for a unit without a rotating turret. The head-carrying slider is then attached by hand, up to the point of its engagement of the screw, and the precise positioning and the vertical working movements can be obtained by electrical remote control.

The invention is of course not intended to be strictly limited to the embodiments which have just been described by way of examples, but also covers the embodiments which do not differ from it except in details, in design and constructional variations or in the use of equivalent means.

For example, it would be possible to supplement the installation by stabilizing pads, located at the ends of the arms, in order to strengthen the contact of the unit against the tube plate.

It would also be possible to equip the unit with a supporting plate, integral with the supporting element and furnished with moving fingers which can engage into the holes of the plate. Such an arrangement would allow the attachment-latches to be relieved of having to carry the reaction torques generated by rotating tools, such as millers or drills, operating on the plate or on the tubes.

Finally, the invention is applicable regardless of the orientation of the tube plate, which may be either vertical or inclined.

What is claimed is:

1. A tool carrier unit movable over a tube plate comprising:

(a) a supporting element in the form of an angle bracket defining a vee, the apex of said vee being, in use, perpendicular to said tube plate;

(b) two slides mounted on said supporting element;

(c) a carriage mounted on each slide for movement in a direction perpendicular to said tube plate;

(d) two perpendicular arms, each mounted on a respective said carriage for movement in a direction parallel to said tube plate;

(e) remotely controllable devices for engaging in holes in said tube plate mounted on said arms;

(f) independent remotely controllable means for moving each said arm on its respective carriage and each said carriage on its respective slide to enable said unit to be moved step by step across said tube plate, by successively engaging each of said arms with said tube plate and moving the other said arm while said one arm is engaged;

(g) said supporting element being provided, within the angle defined thereby, and unaffected by movement of said arms with guides for a tool; and (h) means for moving said tool perpendicularly to said tube plate.

2. A tool-carrier unit according to claim 1, comprising means for moving a tool along said guides within said vee.

3. A tool-carrier unit according to claim 2, comprising a rotating turret at the end of said supporting element opposite the end adjacent said tube plate and provided with supporting guides for a plurality of tool-heads, and means for selectively bringing one of said tool-heads into the interior of said vee of said supporting element, said supporting guides being aligned with said guides in said vee.

* * * * *